US009418623B2

(12) United States Patent
Im et al.

(10) Patent No.: US 9,418,623 B2
(45) Date of Patent: Aug. 16, 2016

(54) BACKLIGHT UNIT WITH OVER-CURRENT DETECTION AND DISPLAY DEVICE HAVING THE SAME

(71) Applicant: Samsung Display Co., Ltd., Yongin, Gyeonggi-Do (KR)

(72) Inventors: Taegon Im, Siheung-si (KR); Myoung-Soo Kim, Asan-si (KR); Hwanwoong Lee, Asan-si (KR); Min-Soo Choi, Asan-si (KR); Eun Chul Shin, Cheonan-si (KR); Dae-Sik Lee, Asan-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 195 days.

(21) Appl. No.: 13/928,582

(22) Filed: Jun. 27, 2013

(65) Prior Publication Data

US 2014/0192102 A1 Jul. 10, 2014

(30) Foreign Application Priority Data

Jan. 8, 2013 (KR) ..... 10-2013-0002033

(51) Int. Cl.
*G09G 3/36* (2006.01)
*G09G 5/10* (2006.01)
*H05B 33/08* (2006.01)

(52) U.S. Cl.
CPC ..... *G09G 5/10* (2013.01); *H05B 33/0827* (2013.01)

(58) Field of Classification Search
CPC ..... G09G 3/3406; G09G 2320/0626; G09G 2320/064; G09G 2320/0646
USPC ..... 345/102; 349/61–70; 362/561
See application file for complete search history.

(56) References Cited

U.S. PATENT DOCUMENTS

| | | | | |
|---|---|---|---|---|
| 8,330,705 | B2 * | 12/2012 | Ye et al. | 345/102 |
| 2007/0296484 | A1 | 12/2007 | Hsia | |
| 2010/0194285 | A1 * | 8/2010 | Byun et al. | 315/125 |
| 2011/0248648 | A1 * | 10/2011 | Liu | 315/294 |

FOREIGN PATENT DOCUMENTS

| | | | |
|---|---|---|---|
| JP | 08256475 | A | 10/1996 |
| JP | 2008210537 | A | 9/2008 |
| JP | 2011187205 | A | 9/2011 |
| KR | 1020060012061 | A | 2/2006 |
| KR | 1020070104804 | A | 10/2007 |
| KR | 1020110051691 | A | 5/2011 |
| KR | 1020110094560 | A | 8/2011 |
| KR | 1020120012877 | A | 2/2012 |

* cited by examiner

*Primary Examiner* — Ram Mistry
(74) *Attorney, Agent, or Firm* — Cantor Colburn LLP

(57) ABSTRACT

A backlight unit includes a power converter configured to generate a light source driving voltage in response to a voltage control signal, a plurality of light emitting diode strings, where each of the light emitting diode strings receives the light source driving voltage through a first terminal thereof, a plurality of transistors corresponding to the light emitting diode strings, where each of the transistors includes: a first electrode connected to a second terminal of a corresponding light emitting diode string thereof; a second electrode; and a control electrode, and a controller connected to the control electrode and the second electrode, where the controller outputs a plurality of current control signals to control electrodes of the transistors and generate the voltage control signal, where the controller generates an over-current detection signal when any one of the current control signals has a pulse width less than a predetermined reference width.

20 Claims, 10 Drawing Sheets

BACKLIGHT UNIT WITH OVER-CURRENT DETECTION AND DISPLAY DEVICE HAVING THE SAME

This application claims priority to Korean Patent Application No. 10-2013-0002033, filed on Jan. 8, 2013, and all the benefits accruing therefrom under 35 U.S. C. §119, the content of which in its entirety is herein incorporated by reference.

BACKGROUND

1. Field

The disclosure relates to a backlight unit and a display device including the backlight unit.

2. Description of the Related Art

A display device is typically employed in electronic devices as one of user interfaces, and a flat-panel display device is widely used as the display device for light weight, slimness, low power consumption of the electronic devices.

A liquid crystal display, which is one of most widely used types of the flat-panel display device, controls an amount of light provided thereto from an exterior to display an image. In the liquid crystal display, the liquid crystal display includes a separately provided light source, i.e., a backlight unit including a backlight lamp, since the liquid crystal display is not self-emissive.

In recent, a light emitting diode ("LED") is widely used as the light source due to the characteristics of the LED including low power consumption, environment-friendly features and slim design, for example.

SUMMARY

The disclosure provides a backlight unit that detects an over-current flowing through a light emitting diode ("LED") string.

The disclosure provides a display device including the backlight unit.

In an exemplary embodiment of the invention, a backlight unit includes a power converter configured to generate a light source driving voltage in response to a voltage control signal, a plurality of LED strings, where each of the LED strings receives the light source driving voltage through a first terminal thereof, a plurality of transistors corresponding to the LED strings, where each of the transistors includes: a first electrode connected to a second terminal of a corresponding LED string thereof; a second electrode; and a control electrode, and a controller connected to the control electrode and the second electrode, where the controller outputs a plurality of current control signals to control electrodes of the transistors and generate the voltage control signal, where the controller generates an over-current detection signal when any one of the current control signals has a pulse width less than a predetermined reference width.

In an exemplary embodiment, the controller may include an over-current detection circuit which outputs the over-current detection signal when the any one of the current control signals has the pulse width less than the predetermined reference range, and the controller controls the power converter such that the light source driving voltage is not generated when the over-current detection signal is output from the over-current detection circuit.

In an exemplary embodiment, the controller may stop generating the voltage control signal such that the light source driving voltage is not generated when the over-current detection signal is output from the over-current detection circuit.

In an exemplary embodiment, the controller may set the voltage control signal to a predetermined level such that the light source driving voltage is not generated when the over-current detection signal is output from the over-current detection circuit.

In an exemplary embodiment, the over-current detection circuit may include a plurality of diodes corresponding to the transistor, where each of the diodes includes a first terminal connected to the control electrode of a corresponding transistor thereof and a second terminal, a resistor connected between a first node therein, which is connected to the second terminal of the diodes, and a source voltage, a second resistor connected between the first node and a ground voltage, a third resistor connected between the first node and a second node therein, and a first comparator which receives a voltage of the second node and a first reference voltage, and outputs the over-current detection signal through an output terminal thereof.

In an exemplary embodiment, the over-current detection circuit may include a fourth resistor connected between the output terminal of the first comparator and the source voltage, and a fifth resistor connected between the output terminal of the first comparator and the source voltage.

In an exemplary embodiment, the controller may further include a voltage control signal generator which generates the voltage control signal in response to a plurality of current control signals, and a switching circuit connected between the source voltage and the voltage control signal generator, where the switching circuit operates in response to the over-current detection signal.

In an exemplary embodiment, the backlight unit may further include a plurality of current controllers corresponding to the LED strings, where each of the current controllers is connected to a second terminal of a corresponding LED string thereof, and generates the current control signals to control a current of the corresponding LED string thereof.

In an exemplary embodiment, each of the current controllers may generate the current control signal having a pulse width corresponding to a forward driving voltage of the corresponding LED string thereof.

In an exemplary embodiment, the backlight unit may further include a plurality of pull-down resistors corresponding to the transistors, where each of the pull-down resistors includes a first end connected to the second electrode of a corresponding transistor thereof and a second end connected to the ground voltage.

In an exemplary embodiment, each of the current controllers may include a resistor connected between the first end of a corresponding pull-down resistor of the pull-down resistors and a third node therein, a second comparator which receives a voltage of the third node and a second reference voltage, and outputs a voltage corresponding to a difference between the voltage of the third node and the second reference voltage to a fourth node therein, a capacitor connected between the third node and the fourth node, and a third comparator which receives a voltage of the fourth node and a third reference voltage and outputs current control signal.

In an exemplary embodiment, the third reference voltage may be a triangular wave or a sawtooth wave, which has a predetermined frequency.

In an exemplary embodiment, a display device including a display panel which includes a plurality of pixels, a driving circuit which controls the display panel to display an image on the display panel, and a backlight unit which provides light to the display panel. In such an embodiment, the backlight unit includes a power converter which generates a light source driving voltage in response to a voltage control signal, a plurality of LED strings, where each of the LED strings receives the light source driving voltage through a first terminal thereof, a plurality of transistors corresponding to the LED strings, where each of the transistors includes a first electrode connected to a second terminal of a corresponding LED string, a second electrode, and a control electrode, a plurality of pull-down resistors corresponding to the transistors, where each of the pull-down resistors includes a first end connected to the second electrode of a corresponding transistor thereof and a second end connected to a ground voltage, and a controller connected to the control electrode and the second electrode to output a plurality of current control signals to the control electrode of each transistor and generate the voltage control signal. In such an embodiment, the controller outputs an over-current detection signal when any one of the current control signals has a pulse width greater than a predetermined reference width.

In an exemplary embodiment, the controller may control the power converter such that the light source driving voltage is not generated when the over-current detection signal is output from the over-current detection circuit.

In an exemplary embodiment, the controller may stop generating the voltage control signal such that the light source driving voltage is not generated when the over-current detection signal is output from the over-current detection circuit.

In an exemplary embodiment, the controller may set the voltage control signal to a predetermined level such that the light source driving voltage is not generated when the over-current detection signal is output from the over-current detection circuit.

In an exemplary embodiment, the over-current detection circuit may include a plurality of diodes corresponding to the transistors, where each of the diodes includes a first terminal connected to the control electrode of a corresponding transistor thereof and a second terminal, a resistor connected between a first node therein, which is connected to the second terminal of the diodes, and a source voltage, a second resistor connected between the first node and a ground voltage, a third resistor connected between the first node and a second node therein, and a first comparator which receives a voltage of the second node and a first reference voltage, and outputs the over-current detection signal through an output terminal thereof.

In an exemplary embodiment, the controller may further include a voltage control signal generator which generates the voltage control signal in response to the current control signals and a switching circuit connected between the source voltage and the voltage control signal generator, where the switching circuit operates in response to the over-current detection signal.

In an exemplary embodiment, the display device may further include a plurality of current controllers corresponding to the LED strings, where each of the current controllers is connected to a second terminal of a corresponding LED string thereof, and generates a current control signal of the current control signals to control a current of the corresponding LED string thereof.

In an exemplary embodiment, each of the current controllers may generate the current control signal having a pulse width corresponding to a forward driving voltage of the corresponding LED string thereof.

According to exemplary embodiments, the backlight unit detects the over-current flowing through the LED strings, such that the LED strings is effectively prevented from being damaged due to the over-current flowing through the LED strings.

BRIEF DESCRIPTION OF THE DRAWINGS

The above and other features of the invention will become readily apparent by reference to the following detailed description when considered in conjunction with the accompanying drawings, in which.

DETAILED DESCRIPTION

Figure 1:
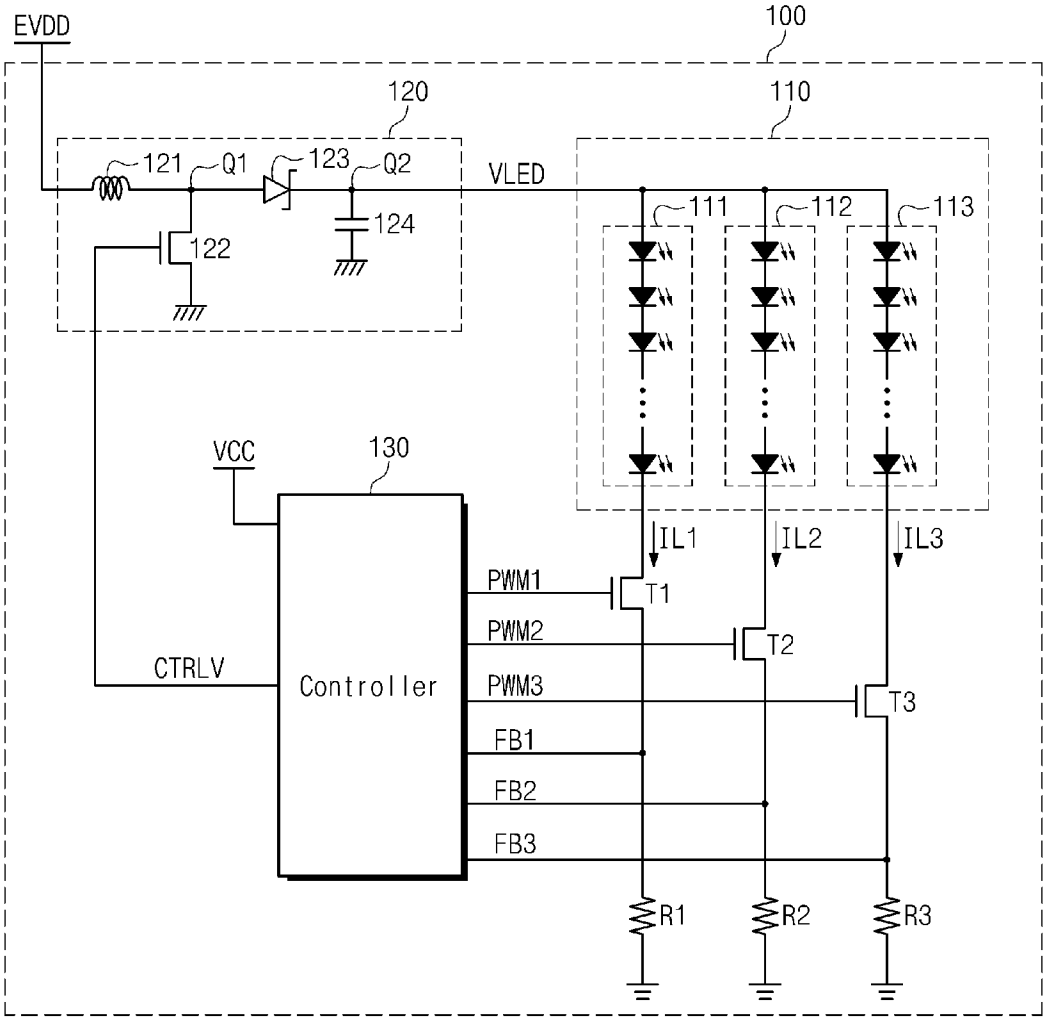
FIG. 1 is a circuit diagram showing an exemplary embodiment of a backlight unit according to the invention.

The invention will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded.

Thus, the regions illustrated in the figures are schematic in nature and their shapes are not intended to illustrate the precise shape of a region and are not intended to limit the scope of the claims set forth herein.

All methods described herein can be performed in a suitable order unless other wise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in detail with reference to the accompanying drawings.

FIG. 1 is a circuit diagram showing an exemplary embodiment of a backlight unit according to the invention.

Referring to FIG. 1, a backlight unit 100 includes a light source 110, a power converter 120, a controller 130, a plurality of resistors, e.g., a first resistor R1, a second resistor R2 and a third resistor R3, and a plurality of transistors, e.g., a first transistor T1, a second transistor T2 and a third transistor T3. In an exemplary embodiment, the resistors T1, T2 and T3 may be pull-down resistors. The backlight unit 100 may be a light source of a display panel of a liquid crystal display. Hereinafter, the backlight unit 100 employed in the display panel will be described, but not be limited thereto. In an alternative exemplary embodiment, the backlight unit 100 may be employed in various devices, e.g., an illumination device, a commercial image board, etc.

The light source 110 includes a plurality of light emitting diode ("LED") strings 111, 112 and 113. In an exemplary embodiment, as shown in FIG. 1, the light source 110 includes three LED strings, e.g., a first LED string 111, a second LED string 112 and a third LED string 113, but the number of the LED strings should not be limited to three.

Each of the LED strings 111, 112 and 113 includes a plurality of LEDs connected to each other in series. Each LED includes a white LED that emits white light, a red LED that emits red light, a blue LED that emits blue light, and a green LED that emits green light. The white, red, blue and green LEDs have different light emitting characteristics from each other, e.g., forward driving voltages (Vf) of the LEDs. As the forward driving voltage of the LEDs decreases, power consumption of the LEDs decreases. In an exemplary embodiment, when a deviation of the forward driving voltage (Vf) small, uniformity of brightness may be effectively secured. In an exemplary embodiment, as shown in FIG. 1, the light source 110 includes the LED strings 111, 112 and 113, each including the LEDs, but not being limited thereto. In an alternative exemplary embodiment, with the light source 110 may include laser diodes or carbon nano tubes, for example.

An end, e.g., a first end, of each of the LED strings 111, 112 and 113 is connected to a light source driving voltage VLED from the power converter 120. The other end, e.g., a second end, of each of the LED strings 111, 112 and 113 is connected to a corresponding transistor of the transistors, e.g., the first transistor T1, the second transistor T2 or the third transistor T3. The first transistor T1 is connected between the other end of the first LED string 111 and an end, e.g., a first end, of the first resistor R1 and includes a gate terminal controlled by a first current control signal PWM1. The first transistor T2 is connected between the other end of the second LED string 112 and an end, e.g., a first end, of the second resistor R2 and includes a gate terminal controlled by a second current control signal PWM2. The third transistor T3 is connected between the other end of the third LED string 113 and an end, e.g., a first end, of the third resistor R3 and includes a gate terminal controlled by a third current control signal PWM3. The other end, e.g., a second end, of each of the resistors R1, R2 and R3 is grounded.

The power converter 120 converts a source voltage EVDD from an external device to the light source driving voltage VLED. The light source driving voltage VLED has a voltage level, which may be higher than a predetermined voltage to drive the LEDs of the LED strings 111, 112 and 113.

The power converter 120 includes an inductor 121, an n-type metal-oxide-semiconductor ("NMOS") transistor 122, a diode 123 and a capacitor 124. The inductor 121 is connected between the source voltage EVDD and a first node Q1 in the power converter 120. The NMOS transistor 122 is connected between the first node Q1 and a ground voltage. The NMOS transistor 122 includes a gate electrode which receives a voltage control signal CTRLV from the controller 130. The diode 123 is connected between the first node Q1 and a second node Q2 in the power converter. In an exemplary embodiment, the diode 123 may be a Schottky diode. The capacitor 124 is connected between the second node Q2 and the ground voltage. The light source driving voltage VLED at the second node Q2 is applied to the first end of each of the LED strings 111, 112 and 113.

In such an embodiment, the power converter 120 converts the source voltage EVDD to the light source driving voltage VLED. In an exemplary embodiment, the NMOS transistor 122 is turned on or off in response to the voltage control signal CTRLV applied to the gate electrode of the NMOS transistor 122, and thus the voltage level of the light source driving voltage VLED is controlled.

The controller 130 receives a source voltage VCC. The controller 130 receives a current flowing through a node, at which the first transistor T1 and the first resistor R1 are connected to each other, as a first feedback signal FB1 and outputs the first current control signal PWM1 to the gate terminal of the first transistor T1. The controller 130 receives a current flowing through a node, at which the second transistor T2 and the second resistor R2 are connected to each other, as a second feedback signal FB2 and outputs the second current control signal PWM2 to the gate terminal of the second transistor T2. The controller 130 receives a current flowing through anode, at which the third transistor T3 and the third resistor R3 are connected to each other, as a third feedback signal FB3 and outputs the third current control signal PWM3 to the gate terminal of the third transistor T3.

The first transistor T1 is turned on or off in response to the first current control signal PWM1. The current flowing through the first LED string 111 is controlled by the turning on and off of the first transistor T1. The second transistor T2 is turned on or off in response to the second current control signal PWM2. The current flowing through the second LED string 112 is controlled by the turning on and off of the second transistor T2. The third transistor T3 is turned on or off in response to the third current control signal PWM3. The current flowing through the third LED string 113 is controlled by the turning on and off of the third transistor T3.

In an exemplary embodiment, the resistors R1, R2 and R3 compensate non-uniform voltage distribution between the LED strings 111, 112 and 113. In such an embodiment, a resistor of the resistors R1, R2 and R3, which has relatively low resistance, is connected to an LED string of the LED strings 111, 112 and 113, which may receive relatively high forward driving voltage Vf, and another resistor of the resistors R1, R2 and R3, which has relatively high resistance, is connected to an LED string of the LED strings 111, 112 and 113, which may receive relatively low forward driving voltage Vf. In such an embodiment, a total power consumed in the LED strings 111, 112 and 113 and the resistors R1, R2 and R3 may be substantially uniform.

The controller 130 outputs the voltage control signal CTRLV based on the first, second and third current control signals PWM1, PWM2, and PWM3 generated by the first, second and third feedback signals FB1, FB2 and FB3, such that the voltage level of the light source driving voltage VLED is effectively controlled.

Figure 2:
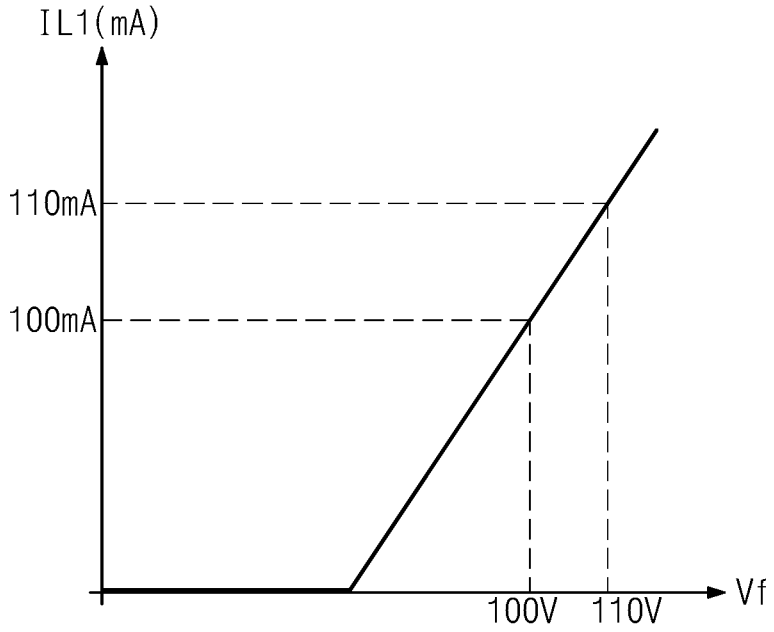
FIG. 2 is a graph of current (milliampere: mA) versus voltage (volt: V) showing a current-voltage characteristic of an exemplary embodiment of a light emitting diode ("LED") string shown in FIG. 1.

FIG. 2 is a graph of current (milliampere: mA) versus voltage (volt: V) showing a current-voltage characteristic of an LED string shown in FIG. 1, and FIG. 3 is a view showing a variation of power consumption based on the current-voltage characteristic of the LED string shown in FIG. 2.

Referring to FIGS. 1 and 2, when the forward driving voltage Vf of the first LED string 111 is about 100 V, a first current IL1 flowing through the first LED string 111 is about 100 mA, and when the forward driving voltage Vf of the first LED string 111 is about 110 V, the first current IL1 flowing through the first LED string 111 is about 110 mA.

Figure 3:
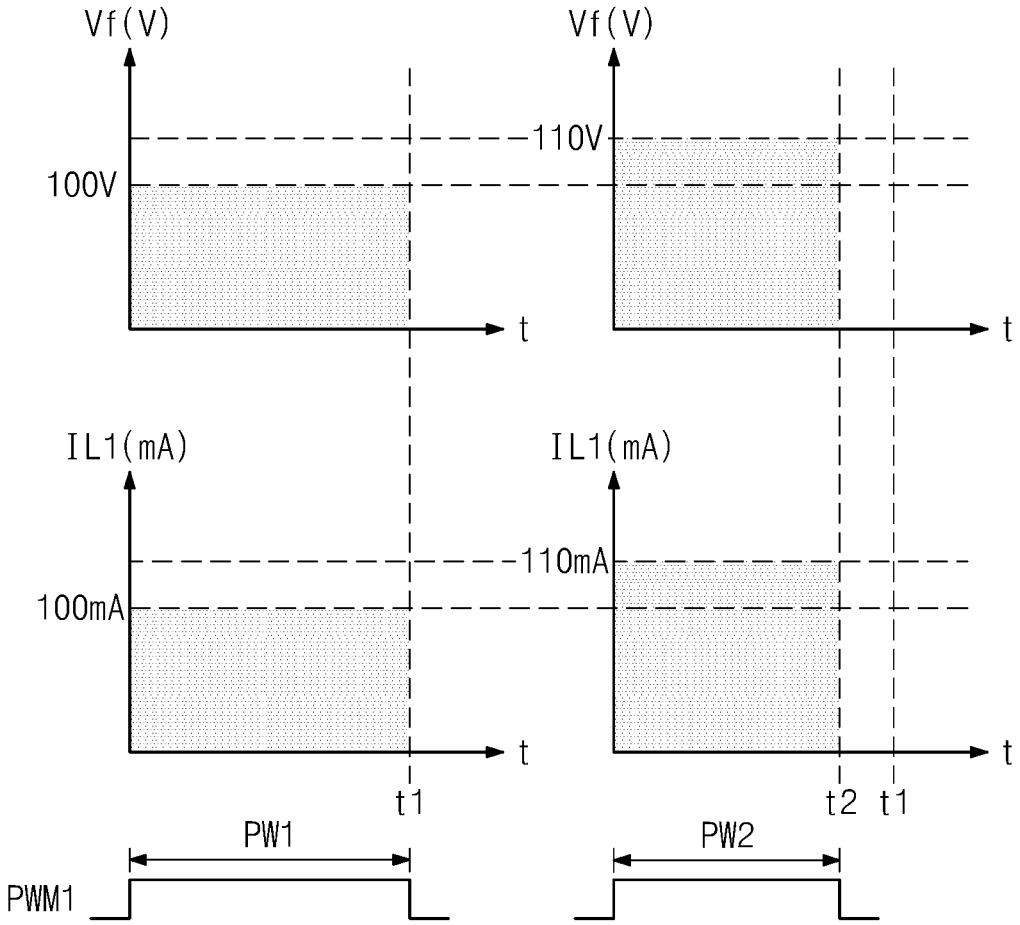
FIG. 3 is a view showing a variation of power consumption based on the current-voltage characteristic of the LED string shown in FIG. 2.

Referring to FIGS. 1 and 3, in an exemplary embodiment, where the forward driving voltages Vf of the first, second and third LED strings 111, 112 and 113 are different from each other, the currents flowing through the first, second and third LED strings 111, 112 and 113, e.g., the first current IL1, a second current IL2 and a third current IL3, respectively, are controlled such that the first, second and third LED strings 111, 112, and 113 have substantially the same brightness as each other. In such an embodiment, the current flowing through the first, second and third LED strings 111, 112 and 113 may be controlled by the turning on and off of the first, second and third transistors T1, T2 and T3, respectively.

In one exemplary embodiment, for example, the first current IL1 of about 100 mA may flow through the first LED string 111 during a predetermined time period t1 when the forward driving voltage Vf of the first LED string 111 is about 100 V. In such an embodiment, the first current IL1 of about 110 mA may flow through the first LED string 111 during a predetermined time period t2 when the forward driving voltage Vf of the LED string 111 is about 110 V to maintain substantially uniform brightness. In such an embodiment, the time period t1 is greater than the time period t2 (t1>t2). In one exemplary embodiment, for example, when t1 is 1, t2 may be t1×0.909.

When the forward driving voltage Vf is about 100 V, power consumption P1 is represented by the following Equation 1.

$$P1=100\text{ V}\times100\text{ mA}\times1.0=10\text{ W} \quad \text{Equation 1}$$

When the forward driving voltage Vf is about 110 V, power consumption P2 is represented by the following Equation 2.

$$P2=110\text{ V}\times110\text{ mA}\times0.909=10.99\text{ W} \quad \text{Equation 2}$$

In such an embodiment, as shown in FIG. 3, a pulse width of the current control signal PWM1 applied to the gate electrode of the first transistor T1 is narrower when the forward driving voltage Vf is about 110 V than when the forward driving voltage Vf is about 100 V (e.g., PW1>PW2). In such an embodiment, the power consumption of the LED strings 111, 112 and 113 is greater when the forward driving voltage Vf is about 110 V than that when the forward driving voltage Vf is about 100 V (e.g., P1<P2).

In an exemplary embodiment, when any one of the LEDs of the LED string 111 is damaged, the amount of the current flowing through the LED string 111 increases, and the increase of the amount of the current flowing through the LED string 111 may cause damage on the LEDs. In an exemplary embodiment, the amount of the current flowing through the LED string 111 is detected.

In such an embodiment, where the display panel including the light source is a three-dimensional image display device, the LED strings 111, 112 and 113 may be periodically turned on and off, and the voltage level of the light source driving voltage VLED may be boosted, thereby uniformly maintaining the brightness of the display panel. As described above, in such an embodiment, when the voltage level of the light source driving voltage VLED becomes substantially high, the LED strings 111, 112 and 113 may be damaged by the increase of the amount of the current flowing through the LED string 111.

In an exemplary embodiment, as shown in FIG. 3, when the amount of the current flowing through the LED string 111 is increased, a pulse width of the first current control signal PWM1 is reduced. In such an embodiment, when at least one pulse width of the first current control signal PWM1, the second current control signal PWM2 and the third current control signal PWM3 is narrower than a predetermined pulse width, an over-current detection signal is output.

Figure 4:
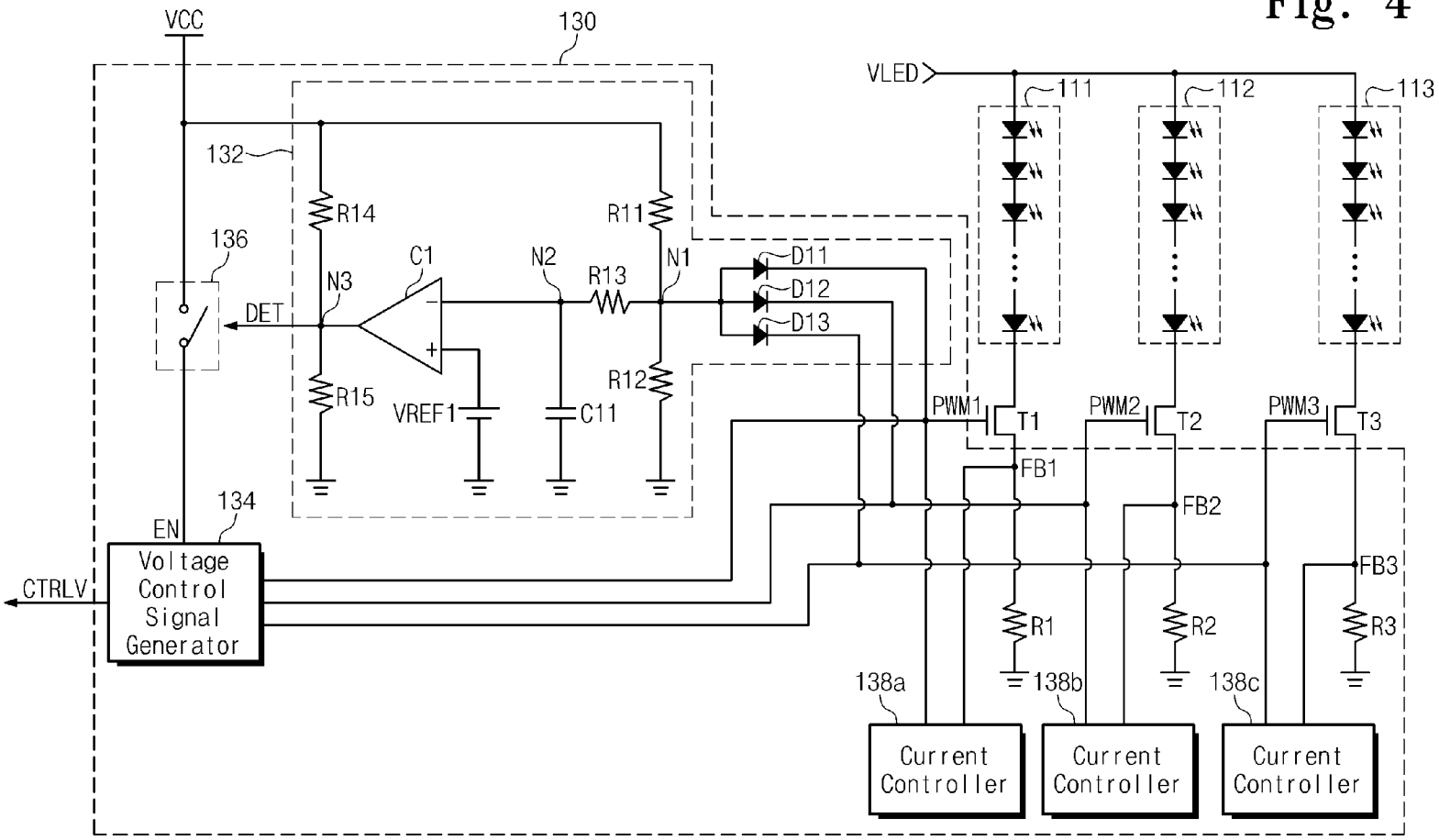
FIG. 4 is a circuit diagram showing an exemplary embodiment of a controller shown in FIG. 1.

FIG. 4 is a circuit diagram showing an exemplary embodiment of a controller shown in FIG. 1.

Referring to FIG. 4, the controller 130 includes an over-current detector 132, a voltage control signal generator 134, a switching circuit 136 and current controllers, e.g., a first current controller 138*a*, a second current controller 138*b* and a third current controller 138*c*.

The over-current detector 132 receives the first, second and third current control signals PWM1, PWM2 and PWM3, and activates the over-current detection signal DET when the narrowest pulse width of the pulse widths of the first, second and third current control signals PWM1, PWM2 and PWM3 is narrower than a reference pulse width.

The voltage control signal generator 134 generates the voltage control signal CTRLV corresponding to the current control signal of the first, second and third current control signals PWM1, PWM2 and PWM3, which has the widest pulse width. In such an embodiment, as described with reference to Equations 1 and 2, the light source driving voltage VLED allows the pulse width of the first, second and third current control signals PWM1, PWM2 and PWM3 to be maximized, the power consumption of the backlight unit 100 may be reduced.

The switching circuit 136 applies the source voltage VCC to the voltage control signal generator 134 in response to the over-current detection signal DET.

The first, second and third current controllers 138*a*, 138*b* and 138*c* correspond to the first, second and third LED strings 111, 112, and 113, respectively. The first current controller 138*a* receives a first feedback signal FB1, and generates the first current control signal PWM1. The second current controller 138*b* receives a second feedback signal FB2, and generates the second current control signal PWM2. The third current controller 138*c* receives a third feedback signal FB3, and generates the third current control signal PWM3.

Hereinafter, the over-current detector 132 will be described in detail.

The over-current detector 132 includes diodes, e.g., a first diode D11, a second diode D12 and a third diode D13, resistors, e.g., first to fifth resistors R11 to R15, a capacitor C11 and a comparator C1. The first, second and third diodes D11, D12 and D13 correspond to the first, second and third LED strings 111, 112 and 113, respectively. An anode terminal of each of the diodes D11, D12 and D13 is connected to a correspond current control signal of the first, second and third current control signals PWM1, PWM2 and PWM3 output from the current controllers 138*a*, 138*b* and 138*c*. A cathode terminal of each of the diodes D11, D12 and D13 is connected to a first node N1. The first resistor R11 is connected between the source voltage VCC and the first node N1 and functions as a pull-up resistor. The second resistor R12 is connected between the first node N1 and the ground voltage, and functions as a pull-up resistor.

The third resistor R13 is connected between the source voltage VCC and a second node N2. The capacitor C11 is connected between the second node N2 and the ground voltage. The comparator C1 receives a voltage of the second node N2 through an inverting terminal thereof and a first reference voltage VREF1 through a non-inverting terminal thereof. The fourth resistor R14 is connected between the source voltage VCC and a third node N3. The fifth resistor R15 is connected between the third node N3 and the ground voltage. The voltage of the third node N3 is output as the over-current detection signal DET.

In an exemplary embodiment, a current path is formed through the source voltage VCC, the first resistor R11, and the diodes D1, D2 and D3, based on a low-to-high or high-to-low transition of the first, second and third current control signals PWM1, PWM2 and PWM3.

In an exemplary embodiment, due to the characteristics of the diodes D1, D2 and D3, the current path is formed through the diode connected to the current control signal having the relatively narrow pulse width among the first, second and third current control signals PWM1, PWM2 and PWM3. Therefore, the voltage of the first node N1 corresponds to the current control signal having the relatively narrow pulse width among the first, second and third current control signals PWM1, PWM2 and PWM3. In such an embodiment, the voltage of the first node N1 is varied based on the relative narrow pulse width of the current control signal of the first, second and third current control signals PWM1, PWM2 and PWM3. In such an embodiment, since the time period to form the current path through the diode becomes longer as the pulse width of the current control signal having the relatively narrow pulse width among the first, second and third current control signals PWM1, PWM2 and PWM3 becomes narrower, the voltage level of the second node N2 is increased.

In an exemplary embodiment, the voltage of the second node N2 rectified by the third resistor R13 and the capacitor C11 is input to the non-inverting terminal of the comparator C1. When the voltage corresponding to the current control signal having the relatively narrow pulse width among the first, second and third current control signals PWM1, PWM2 and PWM3 is lower than the first reference voltage VREF1, the over-current detection signal DET has the high level. In such an embodiment, the voltage corresponding to the current control signal having the relatively narrow pulse width among the first, second and third current control signals PWM1, PWM2 and PWM3 is higher than the first reference voltage VREF1, the over-current detection signal DET has the low level.

Therefore, when the pulse width of the first, second and third current control signals PWM1, PWM2 and PWM3 is narrower than of the reference pulse width corresponding to the first reference voltage VREF1, the over-current detection signal DET is transited to the low level. When the over-current detection signal DET is in the low level, the switching circuit 136 is turned off, and thus the source voltage VCC is not applied to the voltage current signal generator 134. The voltage control signal generator 134 receives the source voltage VCC as an enable signal EN. When the source voltage VCC is not applied to the voltage control signal generator 134, the voltage control signal generator 134 transits the voltage control signal CTRLV to the high level. When the voltage control signal CTRLV is maintained at the high level, the light source driving voltage VLED is not generated since the transistor 122 shown in FIG. 1 is in the turn-on state.

As described above, when the over-current flows through at least one of the LED strings 111 to 113, the generation of the light source driving voltage VLED stops, thereby effectively preventing the LED strings 111 to 113 from being damaged.

Figure 5:
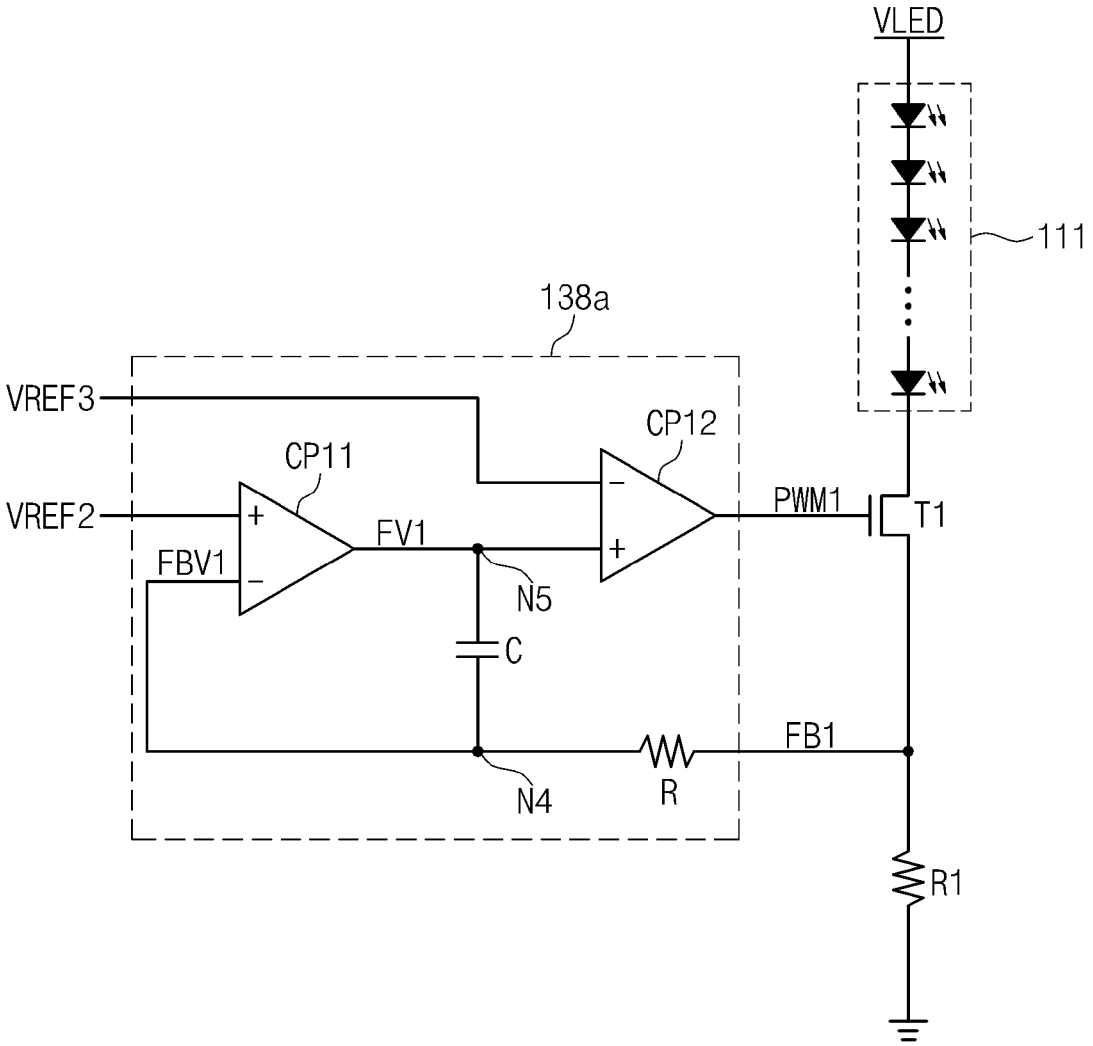
FIG. 5 is a circuit diagram showing an exemplary embodiment of a current controller shown in FIG. 4.

FIG. 5 is a circuit diagram showing an exemplary embodiment of a current controller shown in FIG. 4. In an exemplary embodiment, the first, second and third current controllers 138*a*, 138*b* and 138*c* have substantially the same circuit configuration and function, and thus, for the convenience of description, only one current controller, e.g., the first current controller 138*a*, will be described in detail with reference to FIG. 5.

Referring to FIG. 5, the first current controller 138*a* includes a resistor R, a capacitor C, and comparators, e.g., a first comparator CP11 and a second comparator CP12. The resistor R of the first current controller 138*a* is connected between the first resistor R1 of the backlight unit 100 and a fourth node N4. The capacitor C is connected between the fourth node N4 and a fifth node N5. The first comparator CP11 receives a voltage of the fourth node N4 and a second reference voltage VREF2, and outputs a feedback voltage, e.g., a first feedback voltage FV1. The second comparator C12 receives the feedback voltage FV1 of the fifth node N5 and a third reference voltage VREF3, and outputs the first current control signal PWM1.

Figure 6:
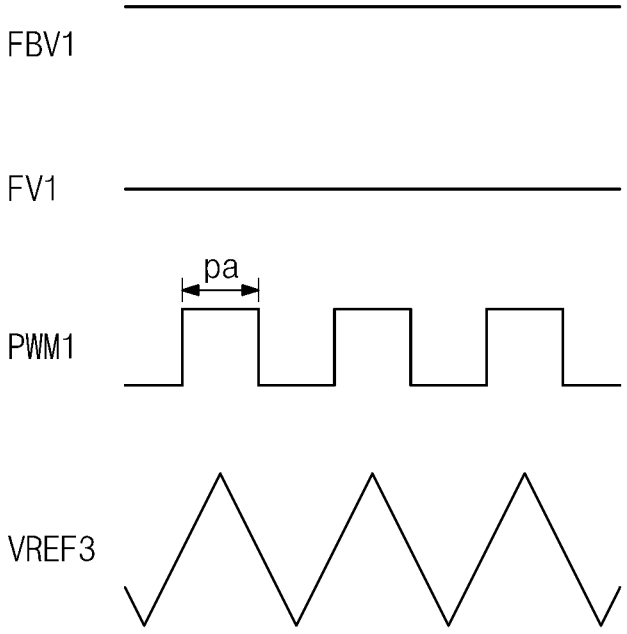
FIG. 6 is a waveform diagram showing signals generated by the current controller shown in FIG. 4.

FIG. 6 is a waveform diagram showing signals generated by the current controller shown in FIG. 4.

Referring to FIGS. 5 and 6, the first feedback signal FB1 from the first resistor R1 of the light source unit 100 is rectified by the capacitor C and the resistor R the first current controller 138*a* to give a direct current voltage FBV1. The first comparator CP11 compares the second reference voltage VREF2 and the direct current voltage FBV1 to output the feedback voltage FV1. The second comparator CP12 compares the feedback voltage FV1 and the third reference voltage VREF3 to output the first current control signal PWM1. In an exemplary embodiment, the third reference voltage VREF3 is a triangular wave or a sawtooth wave, for example.

When the amount of the current flowing through the first LED string 111 is increased, the voltage of the fourth node N4 is increased. As a result, the feedback voltage FV1 output from the comparator CP11 is lowered, and the pulse width pa of the first current control signal PWM1 becomes shorter. Since the turn-on time of the first transistor T1 of the light source unit 100 becomes shorter when the pulse width pa of the first current control signal PWM1 becomes narrower, the amount of the current flowing through the first LED string 111 may be decreased.

When the amount of the current flowing through the LED string 111 is decreased, the voltage of the fourth node N4 is decreased. As a result, the feedback voltage FV1 output from the comparator CP11 become higher, the pulse width pa of the first current control signal PWM1 becomes longer. Since the turn-on time of the transistor T1 becomes longer when the pulse width pa of the first current control signal PWM1 becomes wider, the amount of the current flowing through the LED string 111 may be increased.

As described above, the amount of the current flowing through the first LED string 111 are controlled by adjusting the pulse width pa of the first current control signal PWM1, and the brightness of the LED string 111 is thereby controlled.

Figure 7:
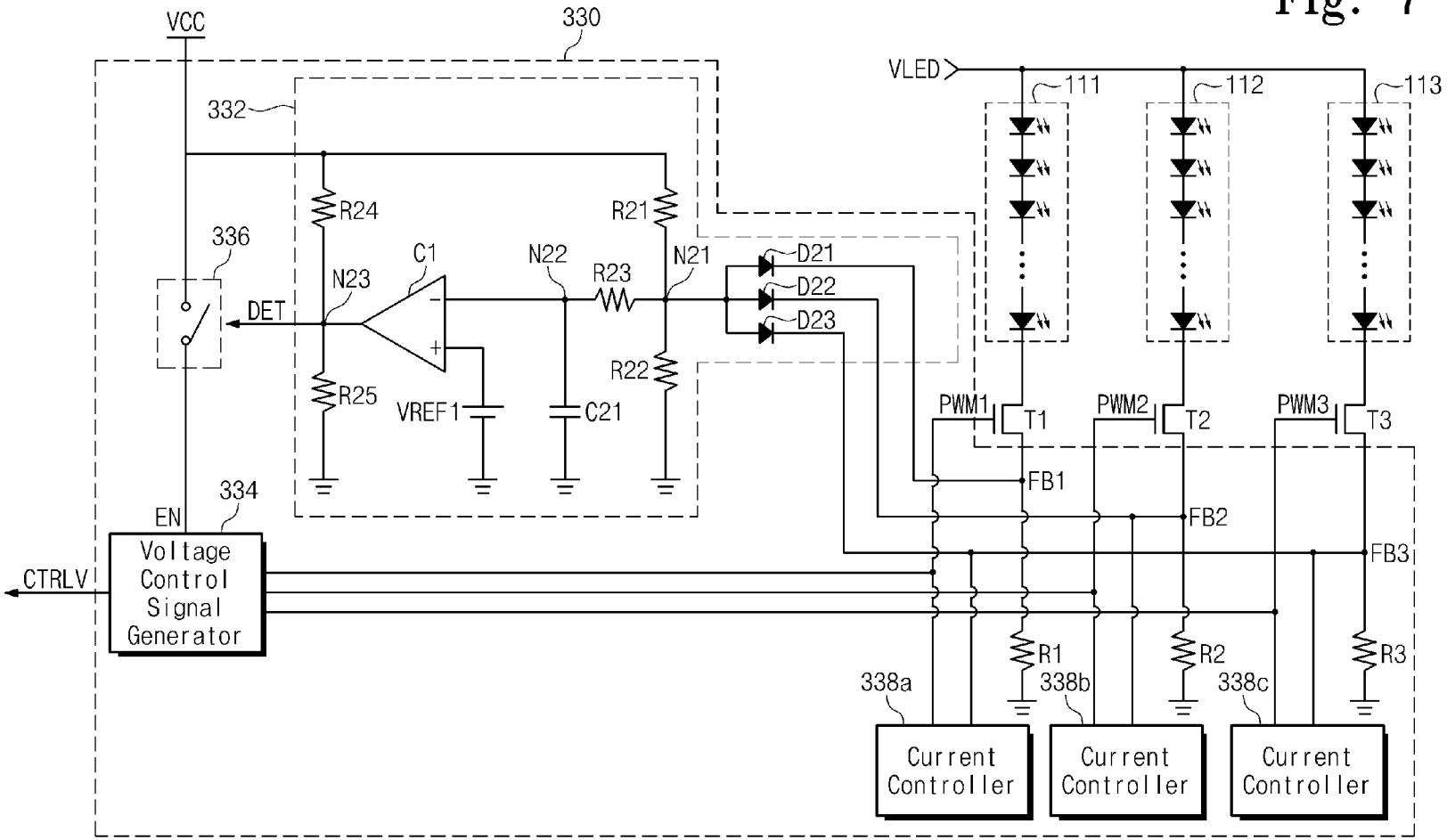
FIG. 7 is a circuit diagram showing an alternative exemplary embodiment of a controller shown in FIG. 1 according to the invention.

FIG. 7 is a circuit diagram showing an alternative exemplary embodiment of a controller shown in FIG. 1 according to the invention.

Referring to FIG. 7, a controller 330 includes an over-current detector 332, a voltage control signal generator 334, a switching circuit 336 and current controllers 338*a*, 338*b* and 338*c*.

The over-current detector 332, the voltage control signal generator 334, the switching circuit 336 and the current controllers 338*a*, 338*b* and 338*c* of the controller 330 shown in FIG. 7 are substantially the same as the over-current detector 132, the voltage control signal generator 134, the switching circuit 136 and the current controllers 138*a*, 138*b* and 138*c* of the controller 130 shown in FIG. 4 except that anode terminals of diodes D21, D22 and D23 are respectively connected to source electrodes of transistors T1, T2 and T3 of the light source unit 100, i.e., first, second and third feedback signals FB1, FB2 and FB3.

Figure 8:
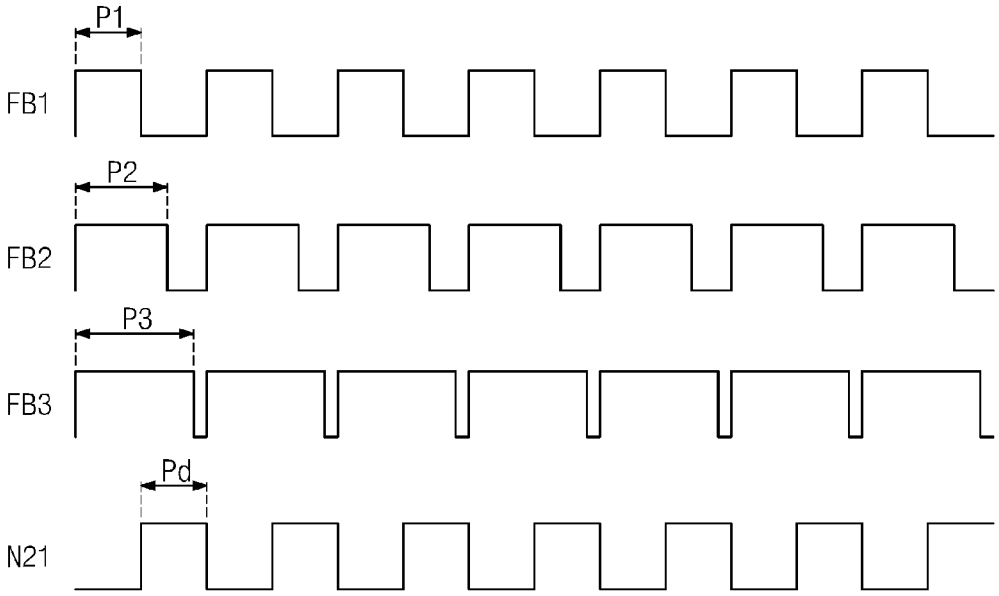
FIG. 8 is a view showing a signal at a node of an over-current detector based on first, second, and third feedback signals shown in FIG. 7.

FIG. 8 is a view showing a signal at a node of the over-current detector based on the first, second and third feedback signals shown in FIG. 7.

Referring to FIG. 8, a first feedback signal FB1 has a first pulse width P1, a second feedback signal FB2 has a second pulse width P2, and a third feedback signal FB3 has a third pulse width P3. A signal of a first node N21 of the over-current detector 332 has a pulse width Pd corresponding to a low-level period of the first feedback signal FB1. As a pulse width of any one of the first, second and third feed back signals FB1, FB2 and FB3 becomes narrower, the pulse width Pd of the signal of the node N21 becomes wider. Therefore, when the pulse width Pd of the signal of the node N21 is wider than a predetermined width, the voltage level of the first reference voltage VREF1 is set to allow the over-current detection signal DET to be transited.

Figure 9:
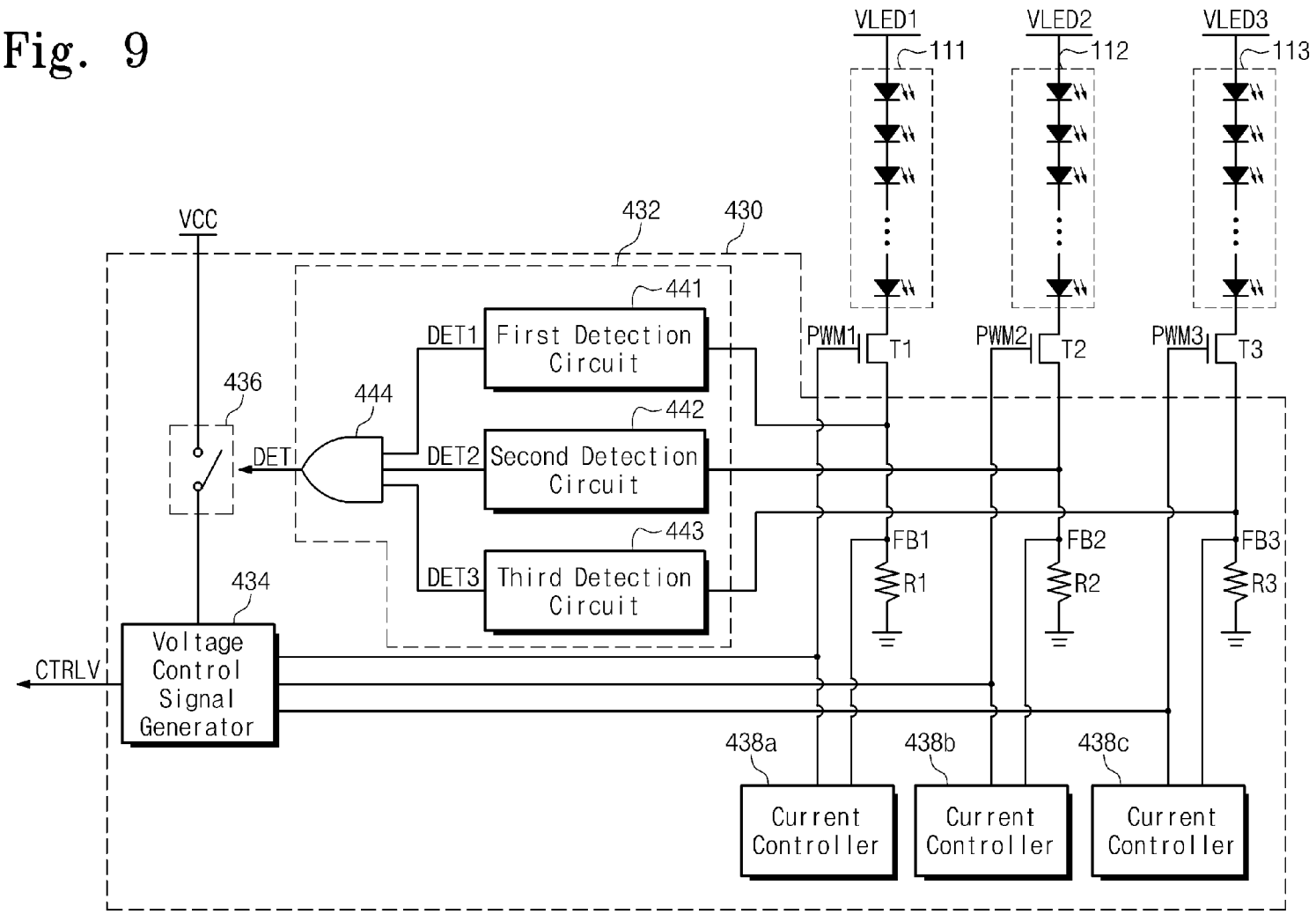
FIG. 9 is a circuit diagram showing another alternative exemplary embodiment of a controller shown in FIG. 1 according to the invention.

FIG. 9 is a circuit diagram showing another alternative exemplary embodiment of a controller shown in FIG. 1 according to the invention.

Referring to FIG. 9, a controller 430 includes an over-current detector 432, a voltage control signal generator 434, a switching circuit 436 and current controllers 438*a*, 438*b* and 438*c*.

The voltage control signal generator 434, the switching circuit 436, and the current controllers 438*a*, 438*b* and 438*c* of the controller 430 shown in FIG. 9 are substantially the same as the voltage control signal generator 334, the switching circuit 336, and the current controllers 338*a*, 338*b* and 338*c* of the controller 330 shown in FIG. 7. In an exemplary embodiment, as shown in FIG. 9, the first, second and third LED strings 111, 112 and 113 are connected to different light source driving voltages, e.g., a first light source driving voltage VLED1, a second light source driving voltage VLED2 and a third light source driving voltage VLED3, respectively.

In an exemplary embodiment, the over-current detector 432 includes a first detection circuit 441, a second detection circuit 442, a third detection circuit 443 and an AND gate 444. The first detection circuit 441 receives the first feedback signal FB1 and outputs a first detection signal DET1, the second detection circuit 442 receives the second feedback signal FB2 and outputs a second detection signal DET2, and the third detection circuit 443 receives the third feedback signal FB3 and outputs a third detection signal DET3. Each of the first, second and third detection circuits 441, 442 and 443 has a circuit configuration substantially the same as the circuit configuration of the over-current detector 332 shown in FIG. 7, except that each of the first, second and third detection circuits 441, 442 and 443 includes one diode connected to a corresponding feedback signal of the first, second and third feedback signals FB1, FB2 and FB3.

Therefore, the first detection circuit 441 outputs the first detection signal DET1 at a low level when the pulse width of the first feedback signal FB1 is narrower than a reference width. The second detection circuit 442 outputs the second detection signal DET2 at a low level when the pulse width of the second feedback signal FB2 is narrower than the reference width. The third detection circuit 443 outputs the third detection signal DET3 at a low level when the pulse width of the third feedback signal FB3 is narrower than the reference width.

The AND gate 444 outputs the over-current detection signal DET when any one of the first, second, and third detection signals DET1, DET2 and DET3 has the low level.

In an exemplary embodiment, the LED strings 111, 112 and 113 are connected to different light source driving voltages VLED1, VLED2 and VLED3, respectively, and the LED strings 111, 112 and 113 thereby independently detect the over-current.

Figure 10:
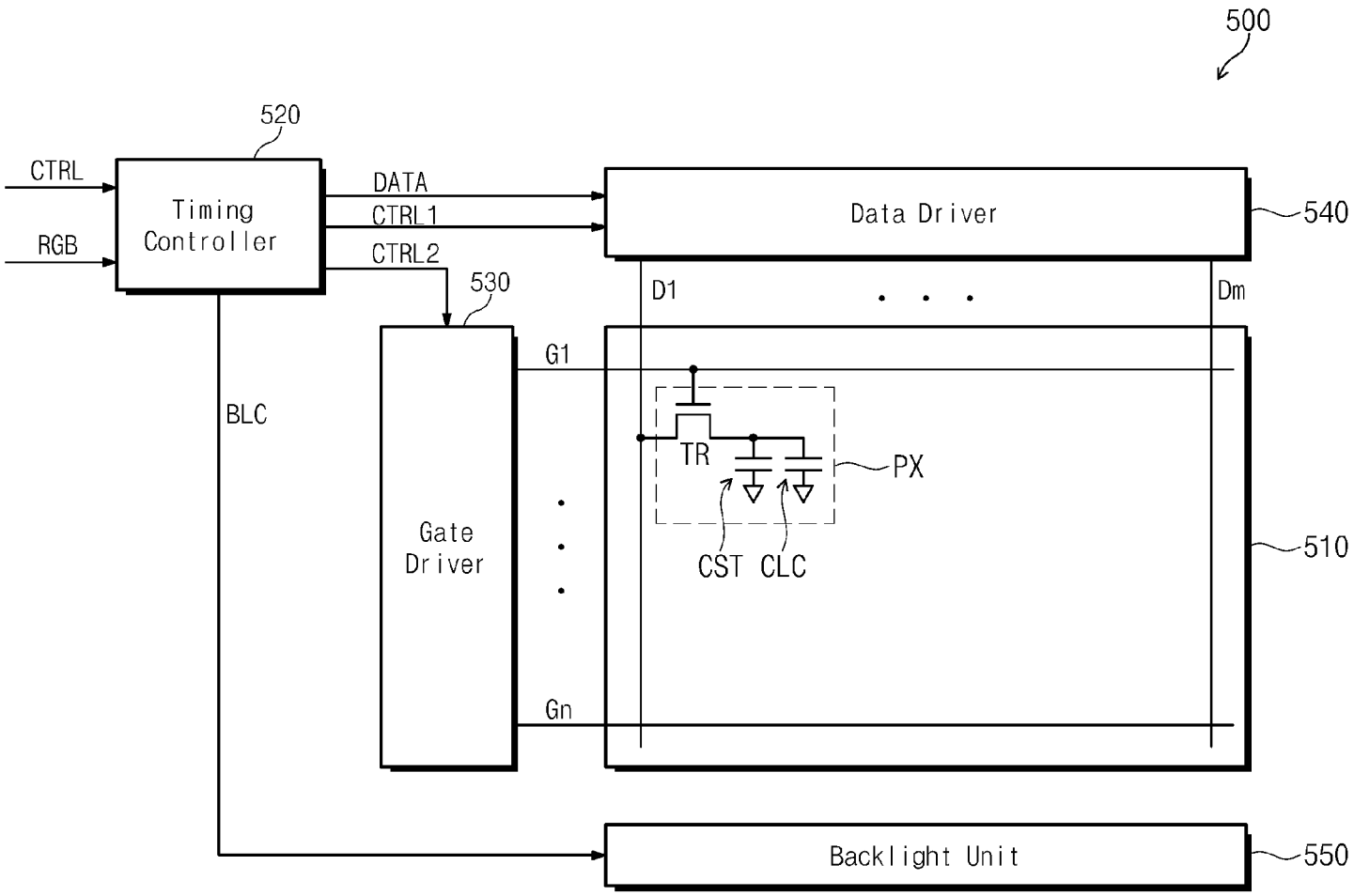
FIG. 10 is a view showing an exemplary embodiment of a display device including a backlight unit according to the invention.

FIG. 10 is a view showing an exemplary embodiment of a display device including the backlight unit according to the invention. Hereinafter, an exemplary embodiment where the display device is a liquid crystal display, but the display device is not limited to the liquid crystal display.

Referring to FIG. 10, a display device 500 includes a display panel 510, a timing controller 520, a gate driver 530, a data driver 540 and a backlight unit 550.

The display panel 510 includes a plurality of data lines D1 to Dm, a plurality of gate lines G1 to Gn crossing the data lines D1 to Dm, and a plurality of pixels PX arranged in pixel areas. In one exemplary embodiment, for example, the pixel areas may be defined by the data lines D1 to Dm and the gate lines G1 to Gn. The data lines D1 to Dm are insulated from the gate lines G1 to Gn.

Each pixel PX includes a switching transistor TR connected to a corresponding data line of the data lines D1 to Dm and a corresponding gate line of the gate lines G1 to Gn, a liquid crystal capacitor CLC connected to the switching transistor TR, and a storage capacitor CST connected to the switching transistor TR.

The timing controller 520, the gate driver 530 and the data driver 540 collectively operate as a driving circuit to control the display panel 510, and thus the image is displayed on the display panel 510.

The timing controller 520 receives image signals RGB and control signals CTRL that controls the image signals RGB, such as a vertical synchronization signal, a horizontal synchronization signal, a main clock signal and a data enable signal, for example, from an external device (not shown). The timing controller 520 processes the image signals RGB based on an operation condition of the display panel 510 using the control signals CTRL to output an image data signal DATA. The timing controller 520 applies the image data signal DATA and a first control signal CTRL1 to the data driver 540 and applies a second control signal CTRL2 to the gate driver 530. The first control signal CTRL1 includes a start pulse signal, a clock signal, a polarity inverting signal and a line latch signal, and the second control signal CTRL2 includes vertical synchronization start signal, an output enable signal and a gate pulse signal.

The gate driver 530 drives the gate lines G1 to Gn in response to the second control signal CTRL2 from the timing controller 520. The gate driver 530 may be configured in a gate driver integrated circuit or in a circuit using oxide semiconductor, amorphous semiconductor, crystalline semiconductor, or polycrystalline semiconductor, for example.

The data driver 540 outputs gray-scale voltages in response to the image data signal DATA and the first control signal CTRL1 from the timing controller 520 to drive the data lines D1 to Dm.

When a gate-on voltage is applied to one gate line by the gate driver 530, switching transistors arranged in a same row and connected to the one gate line are turned on. When the gate-on voltage is applied, the data driver 540 provides the gray-scale voltages corresponding to the image data signal DATA to the data lines D1 to Dm. The gray-scale voltages applied to the data lines D1 to Dm are applied to corresponding liquid crystal capacitors and corresponding storage capacitors through the turned-on switching transistors.

The backlight unit 550 provides light to the display panel 510. The display panel 510 displays the image using the light from the backlight unit 550.

The backlight unit 550 operates in response to a backlight control signal BLC from the timing controller 520. In one exemplary embodiment, for example, the backlight unit 550 controls the brightness in response to the backlight control signal BLC from the timing controller 520 and changes on and off periods thereof in response to the backlight control signal BLC from the timing controller 520. The backlight unit 550 may be the backlight unit 100 shown in FIG. 1, but not being limited thereto.

The backlight unit 550 included in the display device 500 includes the LED strings. The backlight unit 550 detects the over-current flowing through the LED strings and stops the application of the light source driving voltage to the LED strings when the over-current is detected. Therefore, the backlight unit 550 effectively prevents the LED strings from being damaged due to the over-current flowing through the LED strings.

Although the exemplary embodiments of the invention have been described, it is understood that the invention should not be limited to these exemplary embodiments but various changes and modifications can be made by one ordinary skilled in the art within the spirit and scope of the invention as hereinafter claimed.

What is claimed is:

1. A backlight unit comprising:

a power converter configured to generate a light source driving voltage in response to a voltage control signal;

a plurality of light emitting diode strings, wherein each of the light emitting diode strings receives the light source driving voltage through a first terminal thereof;

a plurality of transistors corresponding to the light emitting diode strings, wherein each of the transistors comprises:

a first electrode connected to a second terminal of a corresponding light emitting diode string;

a second electrode; and a control electrode; and a controller connected to the control electrode and the second electrode of each of the transistors comprising an over-current detection circuit and a plurality of current controllers corresponding to the light emitting diode strings respectively and a voltage control signal generator, wherein the current controller outputs a plurality of current control signals to the control electrodes of the transistors and wherein the voltage control signal generator generates the voltage control signal in response to the current control signals, wherein the over-current detector generates an over-current detection signal when any one of the current control signals has a pulse width narrower than a predetermined reference width, wherein the over-current detection circuit comprises:

a plurality of diodes corresponding to the transistors, wherein each of the diodes comprises a first terminal directly connected to the control electrode of a corresponding transistor thereof.

2. The backlight unit of claim 1, wherein the controller controls the power converter such that the light source driving voltage is not generated when the over-current detection signal is output from the over-current detection circuit.

3. The backlight unit of claim 2, wherein the controller stops generating the voltage control signal such that the light source driving voltage is not generated when the over-current detection signal is output from the over-current detection circuit.

4. The backlight unit of claim 2, wherein the controller sets the voltage control signal to a predetermined level such that the light source driving voltage is not generated when the over-current detection signal is output from the over-current detection circuit.

5. The backlight unit of claim 2, wherein the over-current detection circuit further comprises:

a second terminal;

a first resistor connected between a first node therein, which is connected to the second terminals of the diodes, and a source voltage;

a second resistor connected between the first node and a ground voltage;

a third resistor connected between the first node and a second node therein; and a first comparator which receives a voltage of the second node and a first reference voltage, and outputs the over-current detection signal through an output terminal thereof.

6. The backlight unit of claim 5, wherein the over-current detection circuit further comprises:

a fourth resistor connected between the output terminal of the first comparator and the ground voltage; and a fifth resistor connected between the output terminal of the first comparator and the source voltage.

7. The backlight unit of claim 2, wherein the controller further comprises:

a switching circuit connected between the source voltage and the voltage control signal generator, wherein the switching circuit operates in response to the over-current detection signal.

8. The backlight unit of claim 7, wherein the controller further comprises:

a plurality of current controllers corresponding to the light emitting diode strings, respectively, wherein each of the current controllers is connected to a second terminal of a corresponding light emitting diode string, and generates the current control signals to control a current of the corresponding light emitting diode string.

9. The backlight unit of claim 8, wherein each of the current control signals has a pulse width corresponding to a forward driving voltage of the corresponding light emitting diode string.

10. The backlight unit of claim 9, further comprising:

a plurality of pull-down resistors corresponding to the transistors, wherein each of the pull-down resistors comprises:

a first end connected to the second electrode of a corresponding transistor; and a second end connected to a ground voltage.

11. The backlight unit of claim 10, wherein each of the current controllers comprises:

a resistor connected between the first end of a corresponding pull-down resistor of the pull-down resistors and a third node therein;

a second comparator which receives a voltage of the third node therein and a second reference voltage, and outputs a voltage corresponding to a difference between the voltage of the third node and the second reference voltage to a fourth node therein;

a capacitor connected between the third node and the fourth node; and a third comparator which receives a voltage of the fourth node and a third reference voltage, and outputs the current control signal.

12. The backlight unit of claim 11, wherein the third reference voltage is a triangular wave or a saw-tooth wave, which has a predetermined frequency.

13. A display device comprising:

a display panel comprising a plurality of pixels;

a driving circuit which controls the display panel to display an image on the display panel; and a backlight unit which provides light to the display panel, wherein the backlight unit comprises:

a power converter which generates a light source driving voltage in response to a voltage control signal;

a plurality of light emitting diode strings, wherein each of the light emitting diode strings receives the light source driving voltage through a first terminal thereof;

a plurality of transistors corresponding to the light emitting diode strings, wherein each of the transistors comprises:

a first electrode connected to a second terminal of a corresponding light emitting diode string;

a second electrode; and a control electrode;

a plurality of pull-down resistors corresponding to the transistors, wherein each of the pull-down resistors comprises: a first end connected to the second electrode of a corresponding transistor of the transistors; and a second end connected to a ground voltage; and a controller connected to the control electrode and the second electrode to output a plurality of current control signals to the control electrode of each of the transistors comprising an over-current detection circuit and a current controller and a voltage control signal generator, wherein the voltage control signal generator controller generates the voltage control signal, wherein the over-current detector outputs an over-current detection signal when any one of the current control signals has a pulse width narrower than a predetermined reference range, wherein the over-current detection circuit comprises:

a plurality of diodes corresponding to the transistors, wherein each of the diodes comprises a first terminal directly connected to the control electrode of a corresponding transistor of the transistors.

14. The display device of claim 13, wherein the controller controls the power converter such that the light source driving voltage is not generated when the over-current detection signal is activated.

15. The display device of claim 14, wherein the controller stops generating the voltage control signal such that the light source driving voltage is not generated when the over-current detection signal is output from the over-current detection circuit.

16. The display device of claim 14, wherein the controller sets the voltage control signal to a predetermined level such that the light source driving voltage is not generated when the over-current detection signal is output from the over-current detection circuit.

17. The display device of claim 14, wherein the over-current detection circuit further comprises:

a second terminal;

a resistor connected between a first node therein, which is connected to the second terminal of the diodes, and a source voltage;

a second resistor connected between the first node and the ground voltage;

a third resistor connected between the first node and a second node therein; and a first comparator which receives a voltage of the second node and a first reference voltage, and outputs the over-current detection signal through an output terminal thereof.

18. The display device of claim 14, wherein the controller further comprises:

a voltage control signal generator which generates the voltage control signal in response to the current control signals; and a switching circuit connected between the source voltage and the voltage control signal generator, wherein the switching circuit operates in response to the over-current detection signal.

19. The display device of claim 18, wherein the controller further comprises:

a plurality of current controllers corresponding to the light emitting diode strings, wherein each of the current controllers is connected to a second terminal of a corresponding light emitting diode string, and generates a current control signal of the current control signals to control a current of the corresponding light emitting diode string.

20. The display device of claim 19, wherein each of the current controllers generates the current control signal having a pulse width corresponding to a forward driving voltage of the corresponding light emitting diode string.

* * * * *